US012378052B2

(12) United States Patent
Mack

(10) Patent No.: US 12,378,052 B2
(45) Date of Patent: Aug. 5, 2025

(54) SEALED PACKAGE

(71) Applicant: GPI Frankfurt & Augsburg GMBH, Kriftel (DE)

(72) Inventor: Ralf Mack, Munich (DE)

(73) Assignee: Graphic Packaging International, LLC, Atlanta, GA (US)

( * ) Notice: Subject to any disclaimer, the term of this patent is extended or adjusted under 35 U.S.C. 154(b) by 25 days.

(21) Appl. No.: 18/119,891

(22) Filed: Mar. 10, 2023

(65) Prior Publication Data

US 2023/0286719 A1 Sep. 14, 2023

(51) Int. Cl.
*B65D 57/00* (2006.01)
*B65D 75/00* (2006.01)

(52) U.S. Cl.
CPC ..... *B65D 75/004* (2013.01); *B65D 57/00* (2013.01)

(58) Field of Classification Search
CPC .... B65D 75/004; B65D 57/00; B65D 75/305; B65D 81/2015
USPC ..... 206/497; 426/129
See application file for complete search history.

(56) References Cited

U.S. PATENT DOCUMENTS

| | | | | |
|---|---|---|---|---|
| 3,104,012 | A | 9/1963 | Beamish | |
| 3,154,215 | A | 10/1964 | Le Vesconte | |
| 3,575,338 | A | 4/1971 | Dilot | |
| 3,640,188 | A | 2/1972 | Dilot | |
| 3,893,882 | A | 7/1975 | Repenning | |
| 3,941,301 | A | 3/1976 | Jorgensen | |
| 4,057,380 | A | 11/1977 | Hosoe | |
| 4,130,236 | A | 12/1978 | Manizza | |
| 4,283,427 | A | 8/1981 | Winters et al. | |
| 4,325,905 | A | 4/1982 | Takahashi | |
| 4,555,381 | A | 11/1985 | Chazal et al. | |
| 4,718,596 | A | 1/1988 | Muller et al. | |
| 4,840,271 | A | 6/1989 | Gardwood | |
| 4,943,456 | A | 7/1990 | Pollart et al. | |
| 5,000,374 | A | 3/1991 | Deiger | |
| 5,002,826 | A | 3/1991 | Pollart et al. | |
| 5,002,833 | A | 3/1991 | Kinsey, Jr. et al. | |
| 5,085,879 | A * | 2/1992 | Elbaz | B65D 81/025 426/396 |
| 5,118,747 | A | 6/1992 | Pollart et al. | |

(Continued)

FOREIGN PATENT DOCUMENTS

| | | |
|---|---|---|
| CA | 2 814 149 A1 | 4/2012 |
| CN | 203450620 U | 2/2014 |

(Continued)

OTHER PUBLICATIONS

International Search Report and Written Opinion for PCT/US2023/014939 dated Jun. 28, 2023.

*Primary Examiner* — Steven A. Reynolds
(74) *Attorney, Agent, or Firm* — FisherBroyles, LLP

(57) ABSTRACT

A shell for holding one or more products. The shell can comprise a base layer and a barrier layer extending along at least a portion of a face of the base layer, a central wall for receiving at least a portion of the one or more products on an upper side of the central wall, and a stiffening structure extending at least partially around the central wall. The stiffening structure can be configured for resisting bending of at least a portion of the shell toward the upper side of the central wall. The stiffening structure can comprise at least a recess extending along at least a portion of the central wall.

29 Claims, 4 Drawing Sheets

(56) References Cited

U.S. PATENT DOCUMENTS

| | | | | |
|---|---|---|---|---|
| 5,203,491 | A | 4/1993 | Marx et al. | |
| 5,326,021 | A | 7/1994 | Farrell | |
| 5,410,135 | A | 4/1995 | Pollart et al. | |
| 5,412,187 | A | 5/1995 | Walters et al. | |
| 5,506,036 | A * | 4/1996 | Bergerioux | B32B 27/10 428/483 |
| 5,530,231 | A | 6/1996 | Walters et al. | |
| 5,533,622 | A | 7/1996 | Stockley, III | |
| 5,533,623 | A | 7/1996 | Fischer | |
| 5,647,168 | A | 7/1997 | Gilbert | |
| 6,092,687 | A | 7/2000 | Hupp et al. | |
| 6,149,053 | A | 11/2000 | Chatterton et al. | |
| 6,204,492 | B1 | 3/2001 | Zeng et al. | |
| 6,234,386 | B1 | 5/2001 | Drummond et al. | |
| 6,408,598 | B1 * | 6/2002 | Stockley, III | B65B 31/025 53/433 |
| 6,433,322 | B2 | 8/2002 | Zeng et al. | |
| 6,552,315 | B2 | 4/2003 | Zeng et al. | |
| 6,677,563 | B2 | 1/2004 | Lai | |
| 8,534,460 | B2 | 9/2013 | Wnek et al. | |
| 8,741,443 | B2 | 6/2014 | Hilbish | |
| 8,801,995 | B2 | 8/2014 | Wnek et al. | |
| 9,078,296 | B2 | 7/2015 | Fitzwater | |
| 10,351,329 | B2 | 7/2019 | Lafferty | |
| 11,358,779 | B2 | 6/2022 | Tye | |
| 11,434,038 | B2 | 9/2022 | Tye et al. | |
| 2005/0031814 | A1 | 2/2005 | Dawes | |
| 2006/0057315 | A1 * | 3/2006 | De Coninck | B32B 27/32 428/34.2 |
| 2007/0116806 | A1 | 5/2007 | Parsons | |
| 2007/0272688 | A1 | 11/2007 | Longo et al. | |
| 2008/0035634 | A1 | 2/2008 | Zeng et al. | |
| 2011/0068042 | A1 * | 3/2011 | Palumbo | B65D 75/305 206/557 |
| 2011/0174676 | A1 | 7/2011 | Stockhaus | |
| 2011/0259784 | A1 | 10/2011 | Tye et al. | |
| 2012/0248180 | A1 | 10/2012 | White et al. | |
| 2014/0183198 | A1 | 7/2014 | Slack | |
| 2014/0224866 | A1 | 8/2014 | Littlejohn et al. | |
| 2014/0339230 | A1 * | 11/2014 | Keienburg | B65D 3/04 220/62.12 |
| 2015/0225120 | A1 | 8/2015 | Wnek et al. | |
| 2016/0176611 | A1 * | 6/2016 | Wallace | B65D 81/264 426/106 |
| 2017/0166384 | A1 | 6/2017 | Walsh et al. | |
| 2017/0341355 | A1 | 11/2017 | Peiffer et al. | |
| 2018/0022529 | A1 | 1/2018 | Tye | |
| 2018/0319568 | A1 | 11/2018 | Tye | |
| 2019/0255828 | A1 * | 8/2019 | Ochsmann | B65B 3/02 |
| 2020/0331683 | A1 * | 10/2020 | Ghirardi | B65D 77/204 |

FOREIGN PATENT DOCUMENTS

| | | | |
|---|---|---|---|
| DE | 100 22 552 | | 11/2001 |
| EP | 1 104 744 | A2 | 6/2001 |
| GB | 1 501 764 | | 2/1978 |
| GB | 1 602 625 | | 11/1981 |
| GB | 2 487 765 | A | 8/2012 |
| GB | 2 550 386 | A | 11/2017 |
| JP | 2001-233317 | A | 8/2001 |
| KR | 20-2015-0001140 | U | 3/2015 |
| KR | 10-1539187 | B1 | 7/2015 |
| TW | M 295475 | U | 8/2006 |
| TW | M 301016 | U | 11/2006 |
| WO | WO 2003/041945 | | 5/2003 |
| WO | WO 2007/127371 | | 11/2007 |
| WO | WO 2009/138786 | | 11/2009 |
| WO | WO 2013/002639 | | 1/2013 |
| WO | WO 2014/032059 | A1 | 2/2014 |
| WO | WO 2014/066867 | A1 | 5/2014 |
| WO | WO 2015/009518 | | 1/2015 |
| WO | WO 2019/094057 | A1 | 5/2016 |
| WO | WO 2018/017783 | A1 | 1/2018 |

* cited by examiner

SEALED PACKAGE

CROSS-REFERENCE TO RELATED APPLICATIONS

This application claims the benefit of German Utility Model Application No. 202022101343.8, filed on Mar. 11, 2022.

INCORPORATION BY REFERENCE

The disclosure of German Utility Model Application No. 202022101343.8, which was filed on Mar. 11, 2022, is hereby incorporated by reference as if presented herein in its entirety and is incorporated by reference for all purposes.

BACKGROUND OF THE DISCLOSURE

The present disclosure relates to containers, trays, constructs, etc. for holding one or more products. More specifically, the disclosure is generally directed to a vacuum sealed package or skin packaging with stiffening features.

SUMMARY OF THE DISCLOSURE

In general, one aspect of the disclosure is generally directed to a shell for holding one or more products. The shell can comprise a base layer and a barrier layer extending along at least a portion of a face of the base layer, a central wall for receiving at least a portion of the one or more products on an upper side of the central wall, and a stiffening structure extending at least partially around the central wall. The stiffening structure can be configured for resisting bending of at least a portion of the shell toward the upper side of the central wall. The stiffening structure can comprise at least a recess extending along at least a portion of the central wall.

In another aspect, the disclosure is generally directed to a package that can comprise a shell comprising a base layer and a barrier layer. The shell further can comprise a central wall and a stiffening feature extending from the central wall, the stiffening feature comprising at least a recess. The package also can comprise one or more products supported on the barrier layer of the shell along at least the central wall of the shell. Additionally, the package can comprise a cover film extending along at least a portion of the shell and the one or more products so that the cover film is in contact with at least a portion of the barrier layer and with at least a portion of the one or more products.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Figure 1:
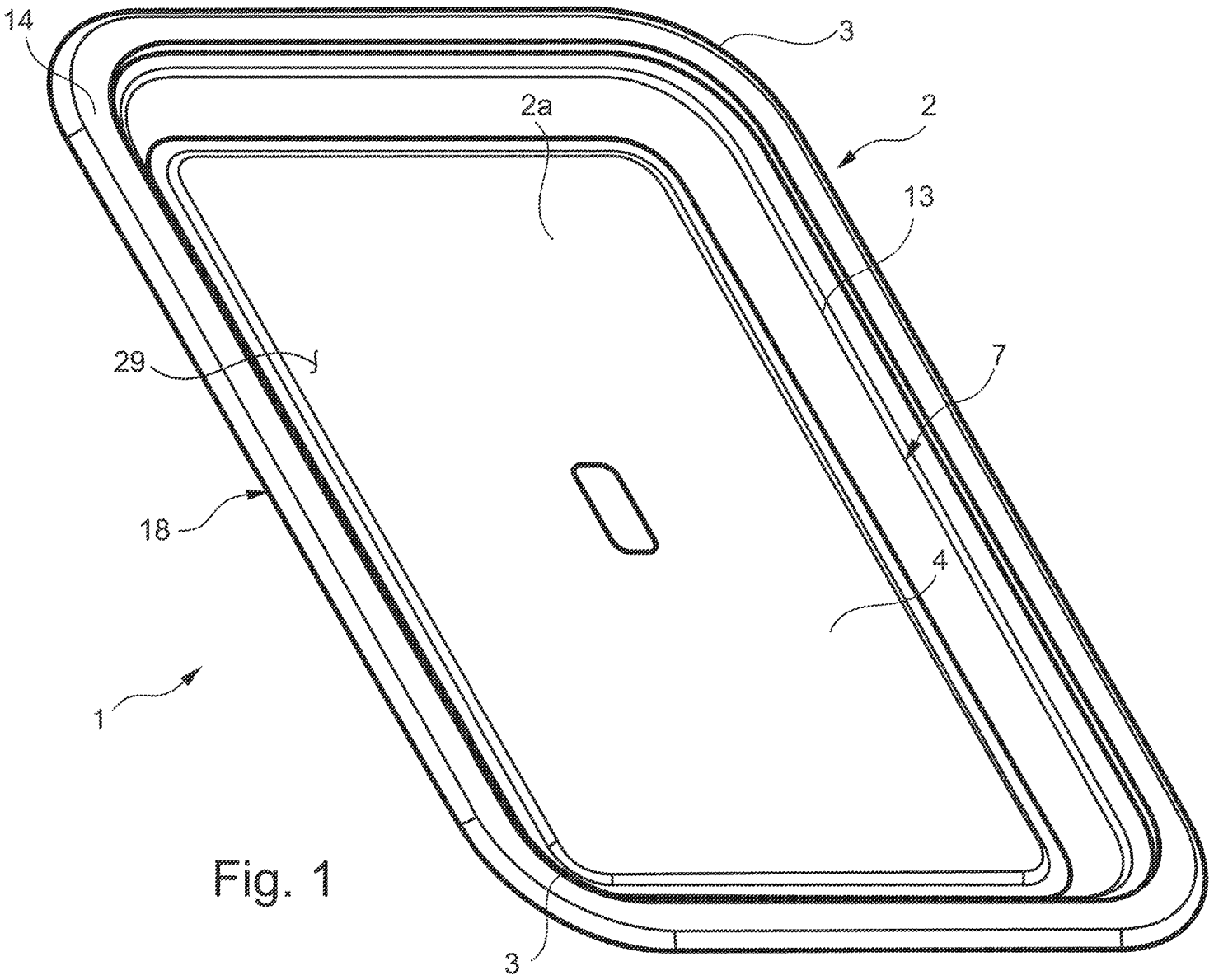
FIG. 1 is a perspective view of a construct or shell used to form a package according to exemplary embodiments of the disclosure.
Figure 3B:
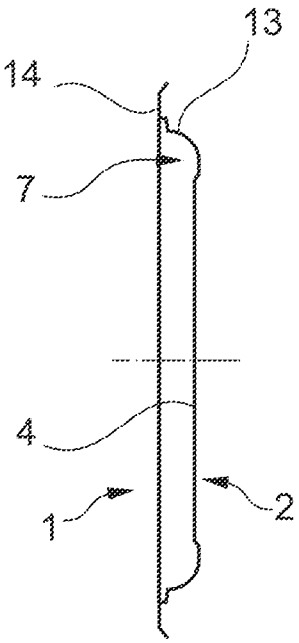
FIGS. 3A and 3B are cross-sectional views of the shell of FIGS. 1 and 2.

The present disclosure relates generally to various aspects of containers, constructs, trays, materials, packages, elements, and articles, and methods of making such containers, constructs, trays, materials, packages, elements, and articles. Although several different aspects, implementations, and embodiments are disclosed, numerous interrelationships between, combinations thereof, and modifications of the various aspects, implementations, and embodiments are contemplated hereby. In one illustrated embodiment, the present disclosure relates to a container or tray for holding food items or various other articles. However, in other embodiments, the container or tray can be used to hold other non-food containing articles and/or may be used for heating or cooking.

Constructs according to the present disclosure can accommodate one or more products or articles of any shape. In this specification, the terms "inner," "interior," "outer," "exterior," "lower," "bottom," "upper," and "top" indicate orientations determined in relation to fully erected and upright constructs and packages. As described herein, constructs can be formed with multiple walls, panels, portions, tabs, flaps, and/or other aspects, which may be designated herein in terms relative to one another, e.g., "first", "second", "third", etc., in sequential or nonsequential reference, without departing from the disclosure.

FIGS. 1-3B illustrate views of a tray 1 including a shell 2 for supporting one or more products 19 in a package 21 (FIG. 6) (e.g., in a vacuum sealed package or skin packaging). In embodiments, the package 21 can include the shell 2, one or more products 19 placed on an upper side 2*a* of the shell 2, and a cover film 20 extending over or covering the one or more products 19 and the shell 2. In exemplary embodiments, the cover film 20 can tightly enclose the one or more products 19 (e.g., can contact or rest against the surfaces of the product) and can be attached to the upper side 2*a* of the shell 2 and/or the one or more products 19. For example, the cover film 20 can be vacuum sealed against the shell 2 and the one or more products 19 and can be attached to the shell 2, as described in more detail below. In embodiments, the one or more products can include food items, such as meat, beef, fish, pork, sheep, poultry, sausage, cheese, and/or any other suitable food items, and the food items can be unitary (e.g., a filet, steak, breast, leg, tenderloin, etc.), sliced (e.g., cold cuts, sliced cheeses or sausages, etc.), cubed, or otherwise prepared. In other embodiments, any suitable products can be included in the package, including nonfood items, such as batteries, USB sticks, memory cards, etc.

Figure 2:
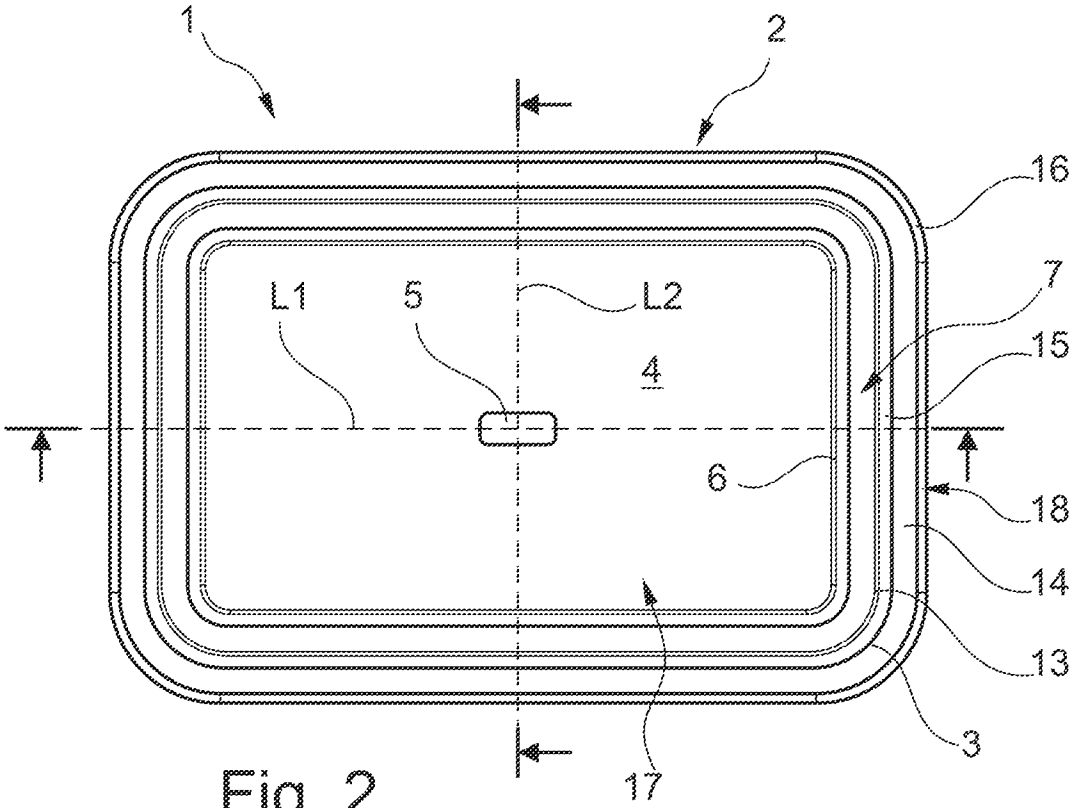
FIG. 2 is a top plan view of the shell of FIG. 1.
Figure 3A:
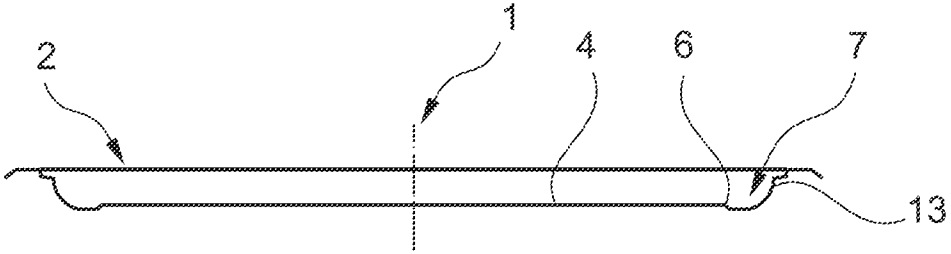

As shown in FIGS. 1 and 2, the shell 2 can have a rectangular shape with rounded corners 3 (e.g., a substantially, generally, and/or approximately rectangular shape with substantially, generally, and/or approximately rounded corners). Alternatively, the shell 2 could have any suitable shape (e.g., circular, oval, annular, polygonal, irregular, etc.). As shown in FIG. 2, the shell 2 can have a longitudinal direction L1 and a lateral direction L2. In the illustrated embodiments, the shell 2 can have a slightly upwardly curved, dome-shaped central or bottom wall 4 (e.g., so that it has a slight camber). In an example, the central wall 4 can have a length of approximately 200 mm, a width of approximately 120 mm, and a thickness of approximately 0.5 mm, and its camber can result in the upper side of the central wall 4 in its center 5 being approximately 1.5 mm higher than the underside of its outer edge or periphery 6. In embodiments, the central wall 4 can have the shape of a spherical cap (e.g., with a very large radius). Alternatively, the central wall 4 can be curved with varying radii, such as having a smaller radius of curvature in its center and a larger radius of curvature at its periphery (e.g., for a shell 2 with a circular shape). In some embodiments, the radius can increase continuously from the center to the periphery of the central wall 4 or can change in steps. In some embodiments, the central panel 4 can be flat at its outer edges (e.g., for a rectangular shell 2). The central wall 4 could be otherwise shaped, arranged, configured, and/or positioned without departing from the disclosure. For example, the central wall 4 could be flat (e.g., a substantially, generally, and/or approximately flat).

Figure 4:
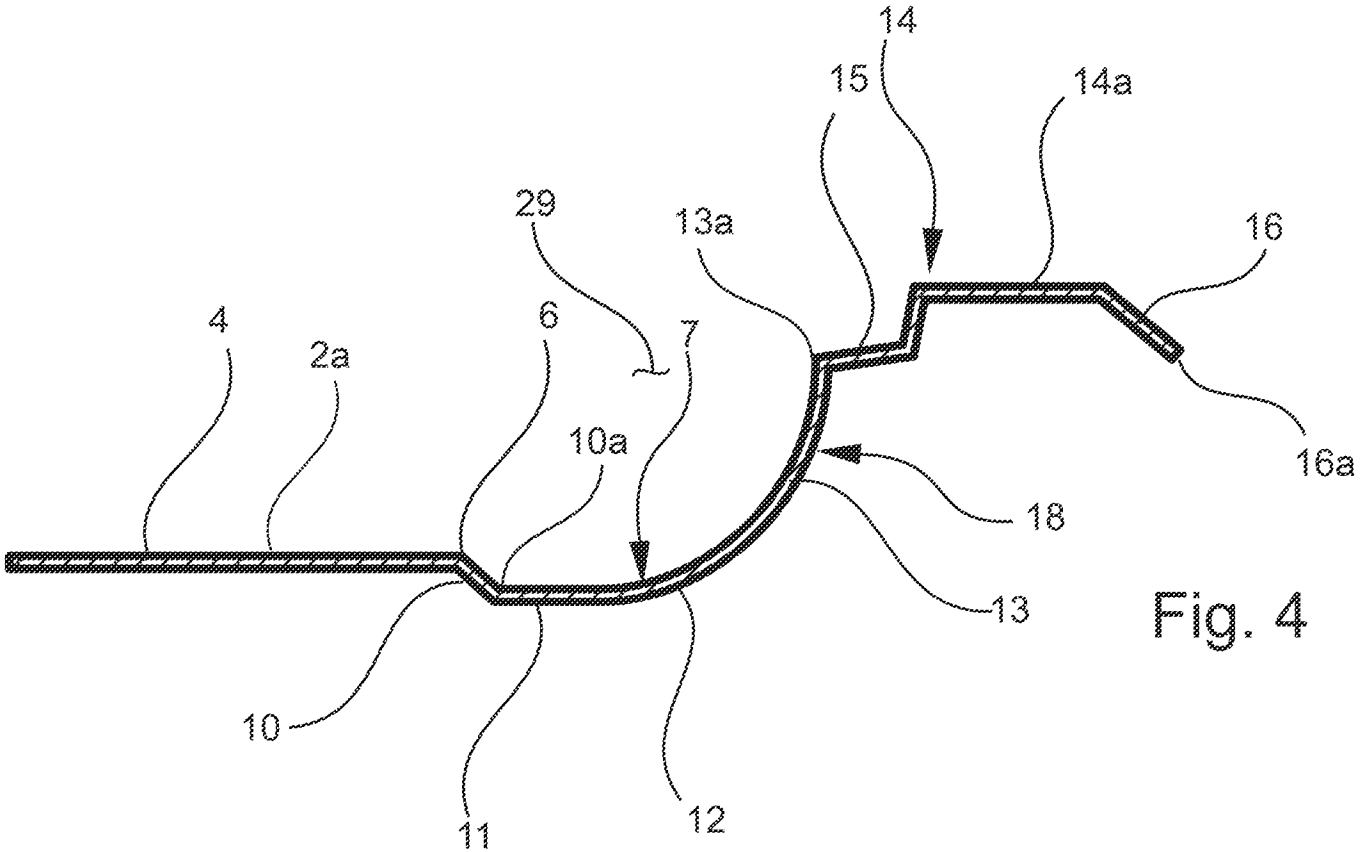
FIG. 4 is a partial cross-sectional view of the shell of FIGS. 1-3B.

As shown in FIGS. 1-4, the shell 2 can have a recess 7 (e.g., a channel-shaped depression) which extends around the central wall 4 and is connected to the central wall 4 along the outer periphery 6 of the central wall 4. In the illustrated embodiments, at least a portion of the recess 7 can be offset downwardly from the central wall 4. As shown in FIG. 4, the recess 7 can be at least partially defined by an inner transition wall 10, a recess base 11, and an outer transition wall 12. In the illustrated embodiments, the inner transition wall 10 can be a chamfer that is straight and oblique, extending downwardly and outwardly from the periphery 6 of the central wall 4. In embodiments, the inner transition wall 10 can be continuous with and can extend from the periphery 6 of the central wall 4 (e.g., the inner transition wall 10 can be integral with the bottom wall 4). In exemplary embodiments, the inner transition wall 10 can extend along the periphery 6 along the perimeter (e.g., the entire perimeter) of the central wall 4. The inner transition wall 10 could be omitted or could be otherwise shaped, arranged, configured, and/or positioned without departing from the disclosure. For example, the inner transition wall 10 could be any suitable shape (e.g., orthogonal, curved, etc.).

In the illustrated embodiments, the recess base 11 can be adjoined to the inner transition wall 10, such as along an outer edge or periphery 10*a* of the inner transition wall 10. In exemplary embodiments, the recess base 11 can be a flat base so that its underside is a planar support surface for supporting the shell 2 on an underlying surface (e.g., a planar surface). In embodiments, the recess base 11 can be continuous with and can extend from the periphery 10*a* of the inner transition wall 10 (e.g., the recess base 11 can be integral with the inner transition wall 10). In exemplary embodiments, the recess base 11 can extend along the periphery 10*a* along the perimeter (e.g., the entire perimeter) of the inner transition wall 10. The recess base 11 could be omitted or could be otherwise shaped, arranged, configured, and/or positioned without departing from the disclosure.

As shown in FIG. 4, the outer transition wall 12 can have a rounded profile that merges smoothly from the recess base 11 into a sidewall 13 of the shell 2 surrounding the recess 7 and the central wall 4. In the illustrated embodiments, the outer transition wall 12 can be continuous with and can extend from the recess base 11 (e.g., can be integral with the recess base 11) along the perimeter (e.g., the entire perimeter) of the recess base 11. Similarly, the sidewall 13 can be continuous with and can extend from the outer transition wall 12 (e.g., can be integral with the outer transition wall 12) along the perimeter (e.g., the entire perimeter) of the outer transition wall 12 and the recess 7. As shown in at least FIGS. 1 and 4, the sidewall 13 can extend around an interior 29 of the shell 2. In embodiments, the sidewall 13, the recess 7, and the central wall 4 can extend along the interior 29. The outer transition wall 12 and/or the sidewall 13 could be omitted or could be otherwise shaped, arranged, configured, and/or positioned without departing from the disclosure.

In the illustrated embodiments, a flange 14 can extend at least outwardly from the sidewall 13. For example, the flange 14 can extend along an outermost and/or uppermost edge or periphery 13*a* of the sidewall 13. In exemplary embodiments, the flange 14 can be continuous with and can extend from the periphery 13*a* of the sidewall 13 (e.g., the flange 14 can be integral with the sidewall 13). In exemplary embodiments, the flange 14 can extend along the periphery 13*a* along the perimeter (e.g., the entire perimeter) of the sidewall 13. In the illustrated embodiments, the flange 14 can include a step 15 that extends generally outwardly from the periphery 13 of the sidewall 13 and then generally upwardly to a horizontal (e.g., substantially, generally, and/or approximately horizontal) flange portion 14*a*. In embodiments, a skirt 16 can extend from the horizontal flange portion 14*a* to an outer edge 16*a* of the flange 14. As shown in FIG. 4, the skirt 16 can extend downwardly and outwardly from the periphery of the horizontal flange portion 14*a*. The flange 14 could be omitted or could be otherwise shaped, arranged, configured, and/or positioned without departing from the disclosure.

In embodiments, a stiffening structure 18 (e.g., a circumferential stiffening structure) of the shell 2 can include the recess 7, the sidewall 13, and/or the flange 14. For example, the inner transition wall 10, the recess base 11, the outer transition wall 12, the sidewall 13, the step 15 of the flange 14, the horizontal portion 14*a* of the flange 14, and/or the skirt 16 can cooperate to stiffen the shell 2 (e.g., against upward bending, which may be caused by the cover film 20, as described in more detail below). In some embodiments, each of the recess 7, the sidewall 13, the flange 14, the inner transition wall 10, the recess base 11, the outer transition wall 12, the step 15, the horizontal flange portion 14*a*, and the skirt 16 could be considered a respective stiffening structure. The stiffening structure 18 could be omitted or could be otherwise shaped, arranged, configured, and/or positioned without departing from the disclosure. For example one or more aspects of the stiffening structure 18 could be omitted.

In exemplary embodiments, the shell 2 can be formed from a flat material (not shown). In some embodiments, flat blanks (not shown) can be cut from sheets or webs of material, which can be supplied from rolls of material, for example. The flat blanks can be press-molded into the shells 2 in a forming tool (not shown), which can include a die with one or more protuberances that presses the flat material into a recessed die, for example. In other embodiments, the shell can be formed (e.g., press-formed) in the larger sheets or webs and can be cut from the sheet or web during or after formation of the shell 2. The shell 2 could be otherwise formed without departing from the disclosure.

Figure 5:
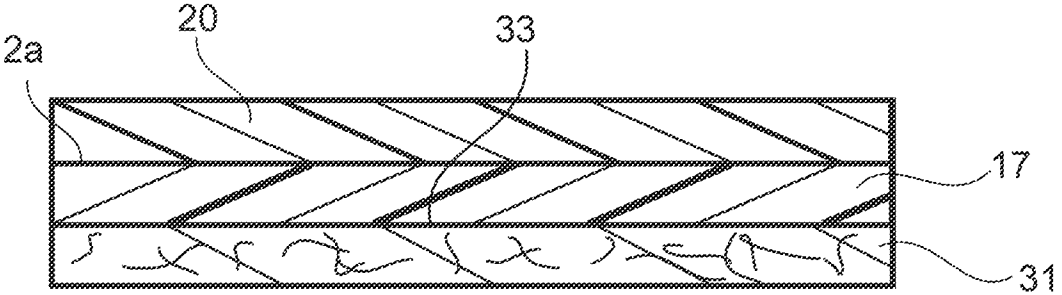
FIG. 5 is a schematic cross-sectional view of a portion of the material of a package formed from the shell of FIGS. 1-4 showing exemplary layers of material according to exemplary embodiments of the disclosure.

As shown in FIG. 5, which schematically shows a cross-section of a portion of the material of the package 21, the material of the shell can include at least a substrate or base layer 31 and a barrier layer 17. In embodiments, the barrier layer 17 can be applied to the base layer 31 (e.g., along an upper face 33 of the base layer 31) before or after the flat material is press-molded into the shell 2. In exemplary embodiments, the base layer 31 can be a material comprising cellulose fibers, such as paperboard, cardboard, or another suitable material. In embodiments, the base layer 31 could be a single layer or multi-layer solid board or a corrugated board. The barrier layer 17 can be a polymer/plastic layer that can be laminated, heat sealed, adhered, or otherwise attached to the upper face 33 of the base layer 31. In some embodiments, the barrier layer 17 can be formed by coating (e.g., flood coating, extrusion coating, etc.) a polymer on the base layer 31. In the illustrated embodiments, the material of the barrier layer 17 can be selected to stabilize the base layer 31 and to provide a reliable barrier to liquids and/or gases (e.g., moisture, oils, ambient air, oxygen, etc.) The base layer 31 and the barrier layer 17 can cooperate to form a solid board with a plurality of layers (e.g., one or more paperboard layers and one or more layers of barrier material).

In exemplary embodiments, the barrier layer 17 can be configured as a peelable barrier film that can be peeled away from the base layer 31 after use of the package (e.g., after removing the one or more products). After separating, the film and the paperboard can be disposed of separately, such as in different waste streams. For example, the paperboard base layer could be recycled and the film could be discarded in a trash or composting waste stream. In embodiments, the paperboard base layer can be readily removable from the barrier film (e.g., after use of the container to hold the one or more products) because the degree of adherence between the base layer 31 and the barrier layer 17 is controllable to give sufficient adherence so that the barrier layer and the base layer remain attached until the one or more products are removed and the packaging is no longer needed, while allowing selective separation of the base layer and the barrier layer after use. In embodiments, by controlling the amount of adhesion between the base layer 31 and the barrier layer 17, the layers can be separated after use while minimizing the contamination between the materials (e.g., minimizing the amount of polymer on the paperboard after separation and/or minimizing the amount of paper material on the barrier layer after separating).

Figure 6:
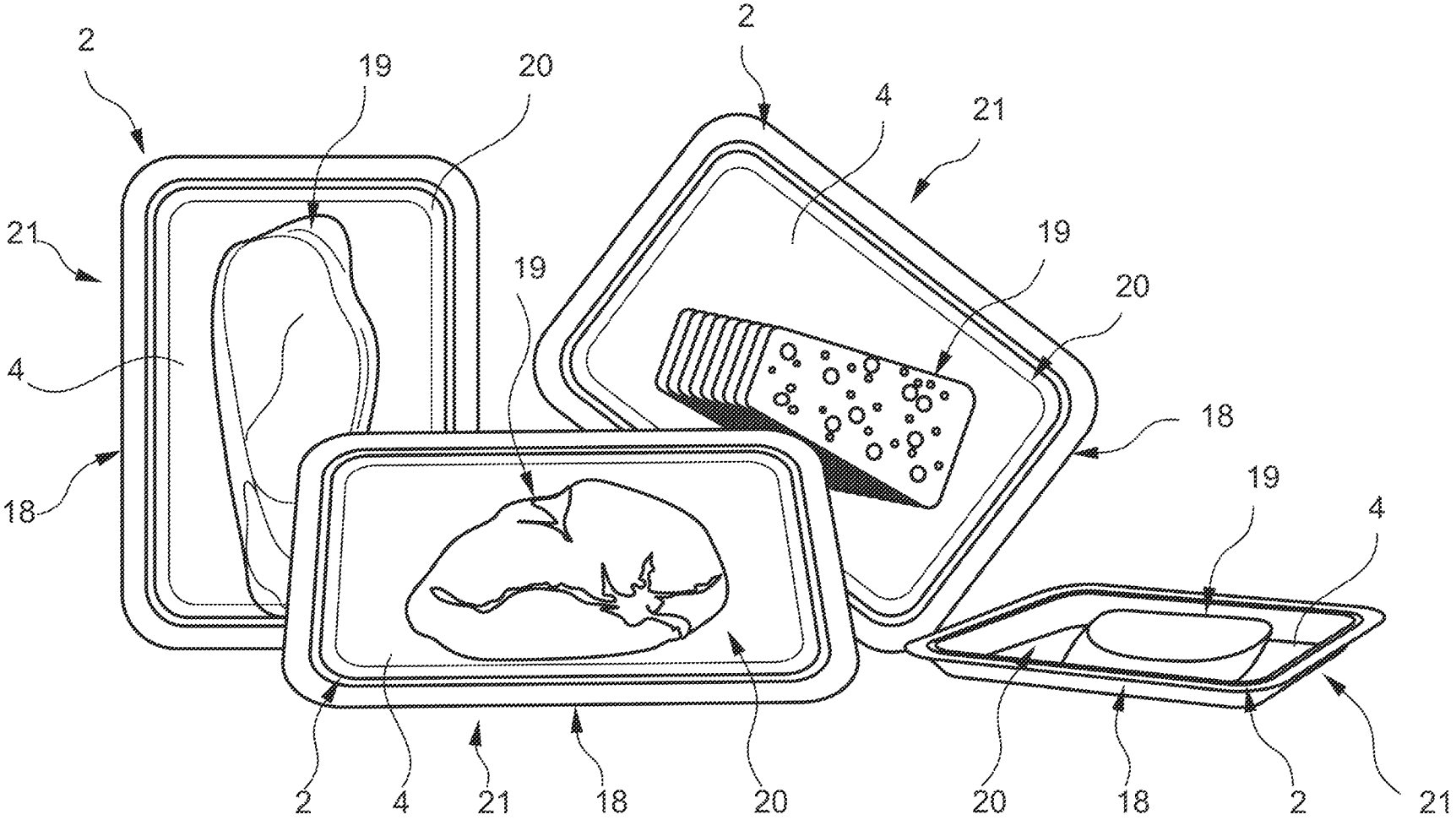
FIG. 6 is a view of a plurality of packages formed from the shell of FIGS. 1-4 with one or more products and a cover film according to exemplary embodiments of the disclosure.

As shown in FIG. 6, the packages 21 can be formed by placing the one or more products 19 on the upper side 2*a* of the central panel 4 (e.g., on the exterior surface of the barrier layer 17). Subsequently, a cover film 20 (e.g., a plastic/polymer film) can be moved over the shell 2 and the one or more products 19 and heat and vacuum pressure are applied to cause the cover film 20 to fit tightly along the surfaces of the one or more products 19 and the portion of the upper surface of the shell 2 not covered by the one or more products 19. For example, a strong vacuum can be applied to draw out the air between the cover film 20 and the shell 2 and one or more products 19 so that the cover film 20 moves against (comes into contact with) the exposed surfaces of the one or more products 19 and shell 2. The cover film 20 is schematically shown applied to the upper face 2*a* of the barrier layer 17 in FIG. 5. In embodiments, the heat applied to the cover film 20 can cause the cover film to become tacky so that it is adhered to the barrier layer 17 where the cover film 20 and the barrier layer 17 come into contact. Alternatively, or in addition, a heat seal layer and/or an adhesive and/or an adhesion promoter can be used to attach the cover film 20 to the shell 2 or to facilitate attachment of the cover film 20 to the shell 2.

In exemplary embodiments, the cover film 20 can form a seal with the barrier layer 17 on the central panel 4 and/or along the surfaces of the recess 7, sidewall 13, and/or flange 14 entirely around the one or more products 19 so that the one or more products 19 are sealed between the barrier layer 17 and the cover film 20 and are protected from ambient air and/or other fluids. For example, the covering film 20 can be sealingly fastened on the surface of the shell 2 so that the arrangement is fixed and no air exchange with the environment is possible. Such vacuum sealed, tightly fitting cover films 20 can be beneficial for certain food items (e.g., meat, fish, poultry, sausage, cheese, etc.) and nonfood items that benefit from removal of air and other fluids and protection from ingress of moisture, air, and/or other fluids. For example, removal of oxygen, carbon dioxide, and/or other gases can help slow or eliminate the biological activity and/or reproduction of microbes in a food item to help prolong its shelf life. In addition, the cover film 20 can be transparent, and the one or more products 19 can be more easily viewed through the closely adjoining transparent cover film 20 by a potential consumer or buyer than if the cover film was not tightly formed against the one or more products (e.g., food and/or nonfood items).

In embodiments, the cover film 20 can apply an upward force on the shell 2. For example, the cover film 20 may contract/shrink during and/or after it is applied to the shell 2 and the one or more products 19, and the adhesion between the cover film 20 and the shell 2 can cause the contracting cover film 20 to pull the shell 2 towards its upper side 2*a*. These upward forces could cause some packages to bend upwardly, such as in the portions that are not covered by the one or more products, and such bending of the package can interfere with storage (e.g., taking up more space and/or making stacking of packages more difficult). Further, such bending can make it more difficult to see the product(s) in the bent package and/or labeling on the package and can make the package less visually appealing. In some packages (e.g., without stiffening features), the thickness of the base layer(s) and/or the barrier layer(s) can be increased to help resist such forces and to help prevent bending of the package.

In the illustrated embodiments, however, the stiffening structure 18 and/or the camber of the central panel 4 can help resist bending (e.g., due to the upward pull of the cover film 20) while allowing the base layer 31 and/or the barrier layer 17 to be thinner than would be needed without the stiffening features. Accordingly, the packages 21 of the illustrated embodiments can help reduce the amount of materials used to form the packages and can help reduce the weight of the packages and costs (e.g., due to materials or transportation) while providing a visually appealing package that allows the one or more products 19 to be inspected easily and that facilitates efficient storage, such as by reducing and/or eliminating upward bending of the shell 2 (e.g., so that the shell 2 substantially maintains its predetermined shape).

In some embodiments, the stiffening features of the shell 2 can allow the shell 2 can have a thickness of less than or equal to approximately 1 mm, less than or equal to approximately 0.5 mm, greater than or equal to 0.1 mm, or greater than or equal to 0.3 mm (e.g., along all portions of the shell). In an example, the shell 2 can have a thickness of approximately 0.5 mm (e.g., along all portions of the shell). In embodiments, a uniform thickness of the shell 2 can facilitate efficient production of the shell during press-molding from a flat material. Alternatively, the shell 2 can have any suitable thickness and/or could have different thicknesses in different portions.

In embodiments, the upwardly curved, dome-shaped bottom of the shell 2 can help resist upward bending of the shell 2 (e.g., at the edges of the central wall 4) due to the forces exerted on the shell 2 by the cover film 20. For example, the upward forces on the shell 2 would need to force the bottom of the shell out of its upwardly curved shape into a downwardly curved shape in order to bend the edges of the central wall 4 upwardly. In embodiments, the shape of the bottom of the shell 2 can also resist or prevent deformation of the shell 2 due to exterior forces, such as forces acting on the outer edges of the package. In exemplary embodiments, only a slight curvature or camber of the bottom of the shell 2 may be sufficient to resist or prevent deformation of the package (e.g., the radius or radii of the dome or spherical cap of the central wall 4 can be very large).

In embodiments, the stiffening structure 18 could be omitted and the camber of the central wall 4 can resist the upward bending of the shell on its own. Alternatively, the shell 2 can a stiffening structure 18 having at least one of the inner transition wall 10, the recess base 11, the outer transition wall 12, the sidewall 13, and the flange 14 extending around the circumference of the central wall 4 for further resisting deformation of the shell 2. In embodiments, the stiffening structure 18 can support the periphery 6 of the central wall 4 to help maintain the upwardly curved dome shape of the central wall 4 and to help prevent bending of the outer portions of the shell upwardly. For example, the central wall 4 would need to be pressed flat and then curved downwardly to allow the outer edges to bend upwardly; however, the stiffening structure 18 can help prevent the widening of the central wall 4 that would occur as it was pushed downwardly from the dome shape to a flattened shape.

In exemplary embodiments, the recess 7 and/or the sidewall 13 can have an added benefit of helping to control liquids in the package 21. For example, liquid that may be released from the one or more products 19 (e.g., during opening of the package 21) can be collected in the recess 7 and/or can be retained by the sidewall 13 to help prevent contamination of surrounding surfaces by the liquids (e.g., in the case that the product(s) are raw animal proteins). Further, the recess 7 and/or the sidewall 13 can help retain larger products and/or solid products that may move around during opening of the package 21. In the illustrated embodiments, the recess 7 and the sidewall 13 can cooperate to stiffen the shell 2 and to retain the product(s) and/or fluids from the products. Alternatively, the sidewall 13 and the flange 14 could be omitted, and the shell would include the recess 7 (including the inner transition wall 10, the recess base 11, and the outer transition wall 12) as the stiffening structure and for retaining fluids, etc.

In embodiments, the inner transition wall 10 can be a bevel that facilitates the formation of a sufficiently deep recess 7 for receiving liquids from the product(s) without significantly reducing the size (e.g., surface area) of the central panel 4 (e.g., relative to a more gradual sloped or curved transition).

In exemplary embodiments, the flange 14 can have the added benefit of providing a grip or handle for holding or lifting the package 21 or the shell 2. In addition, the downwardly angled skirt 16 of the flange 14 can facilitate the chamfering and removal of a protruding edge of the cover film 20 (e.g., when opening the package 21 to remove the product(s) 19) and/or the barrier layer 17 (e.g., to separate the barrier layer 17 and the base layer 31 for disposing the parts in separate waste streams).

In embodiments, the shell 2 and the package 21 of the present disclosure can use less plastic material than other vacuum-sealed packages or skin packagings, such as those that include only plastic materials, e.g., a molded or extruded plastic tray. The paper materials of the illustrated embodiments, can be more sustainable (e.g., made from renewable materials and/or more easily recycled) than plastic packages. Further, the paper-based substrate 31 can be printable on its top and/or its bottom sides. For example, the top side of the base layer 31 can be printed before applying the barrier layer 17. Other paper-based skin packages can include trays that are folded from blanks when erected; however, the press-molded shell 2 of the illustrated embodiments can use less material than folded trays and does not need to be folded and glued prior to filling and applying the cover film 20.

Any of the features of the various embodiments of the disclosure can be combined with, replaced by, or otherwise configured with other features of other embodiments of the disclosure without departing from the scope of this disclosure.

Optionally, one or more portions of the blank or other constructs described herein or contemplated hereby may be coated with varnish, clay, or other materials, either alone or in combination. The coating may then be printed over with product advertising or other information or images. The blanks or other constructs also may be selectively coated and/or printed so that less than the entire surface area of the blank or substantially the entire surface area of the blank may be coated and/or printed.

All dimensional information presented herein is intended to be illustrative of certain aspects, features, etc., of various embodiments of the disclosure, and is not intended to limit the scope of the disclosure. The dimensions of the blanks, containers, forming tools, features, or any other dimension, can be more or less than what is shown and described in this disclosure without departing from the scope of this disclosure and can be within the listed ranges of dimensions for each feature or outside the listed ranges of dimensions for each feature without departing from the scope of this disclosure.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A shell for holding one or more products, the shell comprising:

a base layer comprising cellulose fibers;

a barrier layer extending along at least a portion of a face of the base layer;

a central wall for receiving at least a portion of the one or more products on an upper side of the central wall;

a stiffening structure extending at least partially around the central wall, the stiffening structure being configured for resisting bending of at least a portion of the shell toward the upper side of the central wall;

the stiffening structure comprising at least a recess extending along at least a portion of the central wall; and wherein the barrier layer comprises a peelable barrier film selectively separable from the base layer.

2. The shell of claim 1, wherein the base layer comprises paperboard.

3. The shell of claim 1, wherein the base layer comprises paperboard, and the shell is press-molded to form at least the central wall and the stiffening structure.

4. The shell of claim 1, wherein at least a portion of the recess of the stiffening structure is offset downwardly from the central wall.

5. The shell of claim 1, wherein the stiffening structure comprises a transition wall extending at least downwardly from the periphery of the central wall to a recess base that is spaced downwardly from the central wall by the transition wall.

6. The shell of claim 5, further comprising a sidewall extending at least partially around an interior of the shell and extending at least upwardly from the recess.

7. The shell of claim 6, wherein the stiffening structure further comprises a rounded profile extending from the recess base to the sidewall.

8. The shell of claim 7, further comprising a flange extending at least outwardly from the sidewall.

9. The shell of claim 1, further comprising a sidewall extending at least partially around an interior of the shell and being continuous with at least a portion of the recess.

10. The shell of claim 9, further comprising a flange extending from the sidewall around at least a portion of the shell.

11. The shell of claim 10, wherein the flange comprises a step extending from an upper edge of the sidewall and a skirt that is spaced outwardly from the step and is angled downwardly with respect to a remainder of the flange.

12. The shell of claim 1, further comprising a sidewall extending at least upwardly from the recess and a flange extending at least outwardly from the sidewall, wherein the sidewall and the flange cooperate with the recess to stiffen the shell against bending upwardly.

13. The shell of claim 12, wherein the recess extends around a perimeter of the central wall, the sidewall extends around a perimeter of the recess, and the flange extends around a perimeter of the sidewall.

14. The shell of claim 1, wherein at least a portion of the central wall is dome shaped.

15. A package comprising:

a shell comprising a base layer and a barrier layer, the base layer comprising cellulose fibers, wherein the shell further comprises a central wall and a stiffening feature extending from the central wall, the stiffening feature comprising at least a recess;

one or more products supported on the barrier layer of the shell along at least the central wall of the shell;

a cover film extending along at least a portion of the shell and the one or more products so that the cover film is in contact with at least a portion of the barrier layer and with at least a portion of the one or more products;

wherein the barrier layer comprises a peelable barrier film selectively separable from the base layer.

16. The package of 15, wherein the package is vacuum sealed so that the cover film fits tightly along surfaces of the one or more products and the shell, and wherein the cover film forms a seal with at least a portion of the barrier layer.

17. The package of claim 15, wherein the base layer comprises paperboard, and the shell is press-molded to form at least the central wall and the stiffening structure.

18. The package of claim 15, wherein at least a portion of the recess of the stiffening structure is offset downwardly from the central wall.

19. The package of claim 15, wherein the stiffening structure comprises a transition wall extending at least downwardly from the periphery of the central wall to a recess base that is spaced downwardly from the central wall by the transition wall.

20. The package of claim 19, further comprising a sidewall extending at least partially around an interior of the shell and extending at least upwardly from the recess.

21. The package of claim 20, wherein the stiffening structure further comprises a rounded profile extending from the recess base to the sidewall.

22. The package of claim 15, further comprising a sidewall extending at least partially around an interior of the shell and being continuous with at least a portion of the recess.

23. The package of claim 22, further comprising a flange extending from the sidewall around at least a portion of the shell.

24. The package of claim 23, wherein the flange comprises a step extending from an upper edge of the sidewall and a skirt that is spaced outwardly from the step and is angled downwardly with respect to a remainder of the flange, and wherein the cover film is applied along at least a portion of each of the step and the skirt of the flange.

25. The package of claim 15, further comprising a sidewall extending at least upwardly from the recess and a flange extending at least outwardly from the sidewall, wherein the sidewall and the flange cooperate with the recess to stiffen the shell against bending upwardly, and wherein portions of the cover film overlap the recess, the sidewall, and the flange.

26. The package of claim 15, wherein at least a portion of the central wall is dome shaped.

27. The package of claim 15, wherein the cover film is applied along at least a portion of each of the central panel and the recess.

28. The shell of claim 1, wherein the peelable barrier film and the base layer are separable such that the peelable barrier film and the base layer are disposable in different waste streams after separation.

29. The package of claim 15, wherein the peelable barrier film and the base layer are separable such that the peelable barrier film and the base layer are disposable in different waste streams after separation.

* * * * *